US005101808A

United States Patent [19]

Kobayashi et al.

[11] Patent Number: 5,101,808

[45] Date of Patent: Apr. 7, 1992

[54] OUTSIDE-OF-THORAX TYPE NEGATIVE PRESSURE ARTIFICIAL RESPIRATOR

[75] Inventors: Naoki Kobayashi; Takashi Nakaya; Sakari Yokoyama, all of Tokyo, Japan

[73] Assignee: Nihon Kohden Corporation, Tokyo, Japan

[21] Appl. No.: 571,369

[22] Filed: Aug. 23, 1990

[30] Foreign Application Priority Data

Aug. 23, 1989 [JP] Japan ..... 1-97485

[51] Int. Cl.[5] ..... A61H 31/02

[52] U.S. Cl. ..... 128/30.2; 128/30; 128/204.25

[58] Field of Search ..... 128/28, 30, 30.2, 204.18, 128/204.25, 205.19

[56] References Cited

U.S. PATENT DOCUMENTS

| | | | |
|---|---|---|---|
| 3,333,581 | 8/1967 | Robinson | 128/30.2 |
| 4,257,407 | 3/1981 | Macchi . | |
| 4,621,621 | 11/1986 | Marsalis | 128/30.2 |
| 4,840,167 | 6/1989 | Olsson et al. | 128/30.2 |
| 4,945,899 | 8/1990 | Sugiyama et al. | 128/30 |

FOREIGN PATENT DOCUMENTS

| | | |
|---|---|---|
| 0379049 | 1/1990 | European Pat. Off. . |
| 876315 | 5/1953 | Fed. Rep. of Germany . |
| 876316 | 5/1953 | Fed. Rep. of Germany . |
| 256974 | 3/1917 | United Kingdom . |
| 640894 | 8/1950 | United Kingdom . |
| 2200557A | 2/1987 | United Kingdom . |

*Primary Examiner*—Richard J. Apley
*Assistant Examiner*—J. Doyle
*Attorney, Agent, or Firm*—Sughrue, Mion, Zinn, Macpeak & Seas

[57] ABSTRACT

An artificial respirator includes an atomospheric opening, a corset for enclosing a patient's thorax, an inspiration tube connected at one end thereof to the corset, a suction pump, a switching device for connecting the other end of the inspiration tube to either the suction pump or to the atmospheric opening so as to change the pressure within the corset between a negative and an atmospheric pressure, thereby providing artificial respiration to the patient. The artificial respirator further includes a device for varying the time constant of the change between the negative and atmospheric pressure within the corset so as to provide a smooth change between the pressures.

11 Claims, 3 Drawing Sheets

OUTSIDE-OF-THORAX TYPE NEGATIVE PRESSURE ARTIFICIAL RESPIRATOR

FIELD OF THE INVENTION

The present invention relates to an outside-of-thorax type negative pressure artificial respirator, and more particularly to an outside-of-thorax type negative pressure artificial respirator suited for restraining an abrupt variation in air pressure within a corset.

BACKGROUND OF THE INVENTION

Although there are many types of artificial respirators, the mainstream at present is an apparatus of the positive pressure type which applies positive pressure directly into the trachea. With this apparatus, although the artificial respiration can be positively effected, an incision of the trachea is needed, and the incision portion must be sterilized. A further disadvantage of the positive pressure type respirator is that the patient is unable to consume food or effectively speak. Another type of respirator is a negative pressure type apparatus commonly referred to as an "iron lung". The negative pressure type apparatus also has disadvantages in that it is bulky and is low in efficiency. As a result, the negative pressure type apparatus has been seldomly used in recent years. Another negative pressure type apparatus is one known as an outside-of-thorax type negative pressure artificial respirator. This apparatus includes a corset having a rigid shell for enclosing the thorax of the patient, and forms an air-tight chamber between the thorax and the rigid shell when the corset is attached. By bringing the sealed chamber into a negative pressure, the artificial respiration is carried out. Since this apparatus does not need an incision of the trachea, and can be easily used, the apparatus has recently been extensively used.

FIG. 7 shows a conventional outside-of-thorax type negative pressure artificial respirator including the corset 50 and a suction pump 51 which are interconnected by an inspiration tube 52, and a two-way directional control valve 53 is mounted in a conduit of the inspiration tube 52 so that the inspiration tube 52 can be selectively opened and closed relative to the atmosphere. During the inspiration period, the two-way directional control valve 53 is closed relative to the atmosphere to bring the pressure within the corset 50 to a negative pressure. During the expiration period, the valve 53 is opened relative to the atmosphere to return the pressure within the corset 50 to the atmospheric pressure. By controlling the pressure within corset 50 in this manner, artificial respiration is carried out.

However, in the conventional apparatus shown in FIG. 7 the directional control of the conduit by the two-way directional control valve 53 is instantaneously effected. Specifically, the pressure within corset 50 is abruptly changed between a negative pressure and the atmospheric pressure, as shown in FIG. 8. This results in a problem in that the patient is subjected to an impact which causes pain.

As described above, the conventional outside-of-thorax type negative pressure artificial respirator has a problem in that when the tube pipe connected to the corset is to be opened and closed relative to the atmosphere, the two-way directional control valve achieves the directional control of the conduit instantaneously, and therefore the pressure within the corset is abruptly changed to provide an impact and hence a pain to the patient.

SUMMARY OF THE INVENTION

The present invention has been developed in order to overcome the problems associated with the prior art negative pressure type artificial respirators. Specifically, an object of the invention is to provide an outside-of-thorax type negative pressure artificial respirator which gently varies the change in pressure within a corset during the artificial respiration, thereby preventing pain to the patient.

The above object has been achieved by an outside-of-thorax type negative pressure artificial respirator comprising a corset including a rigid shell for enclosing the thorax of a patient and forming an air-tight sealed chamber between the rigid shell and the thorax when the corset is attached to the patient; an inspiration tube connected at one end to the corset so as to communicate with the air-tight sealed chamber; a suction pump connected to the other end of the inspiration tube; and switching means mounted in a conduit of the inspiration tube so as to switch the connection of the inspiration tube between an atmosphere-opening side and a suction pump-connecting side. The artificial respirator further includes means for applying a fluid flow resistance to a fluid flow passage; and adjustment means for adjusting the variation speed of the air pressure. The adjustment means provides a flow capacitance having a compliance.

The means for applying the fluid flow resistance may be a throttle valve, an air filter, or a long spiral pipe, connected to the fluid flow passage. The means for applying the flow capacitance may be a sealed box connected to the fluid flow passage, an air-tight sealed chamber made of a resilient member and connected to the fluid flow passage, or may be a predetermined volume of space formed between the corset and the thorax.

With the above construction, the time constant of the variation in pressure within the corset can be adjusted to a suitable value by the adjustment means provided on the inspiration tube, thereby making gentle the speed of variation of the pressure within the corset. As a result, the patient is not subjected to an impact due to an abrupt variation of the pressure within the corset, and therefore the pain of the patient can be relieved.

BRIEF DESCRIPTION OF THE DRAWINGS

The invention will be described with reference to the drawings, wherein.

DETAILED DESCRIPTION OF THE PREFERRED EMBODIMENT

Figure 1:
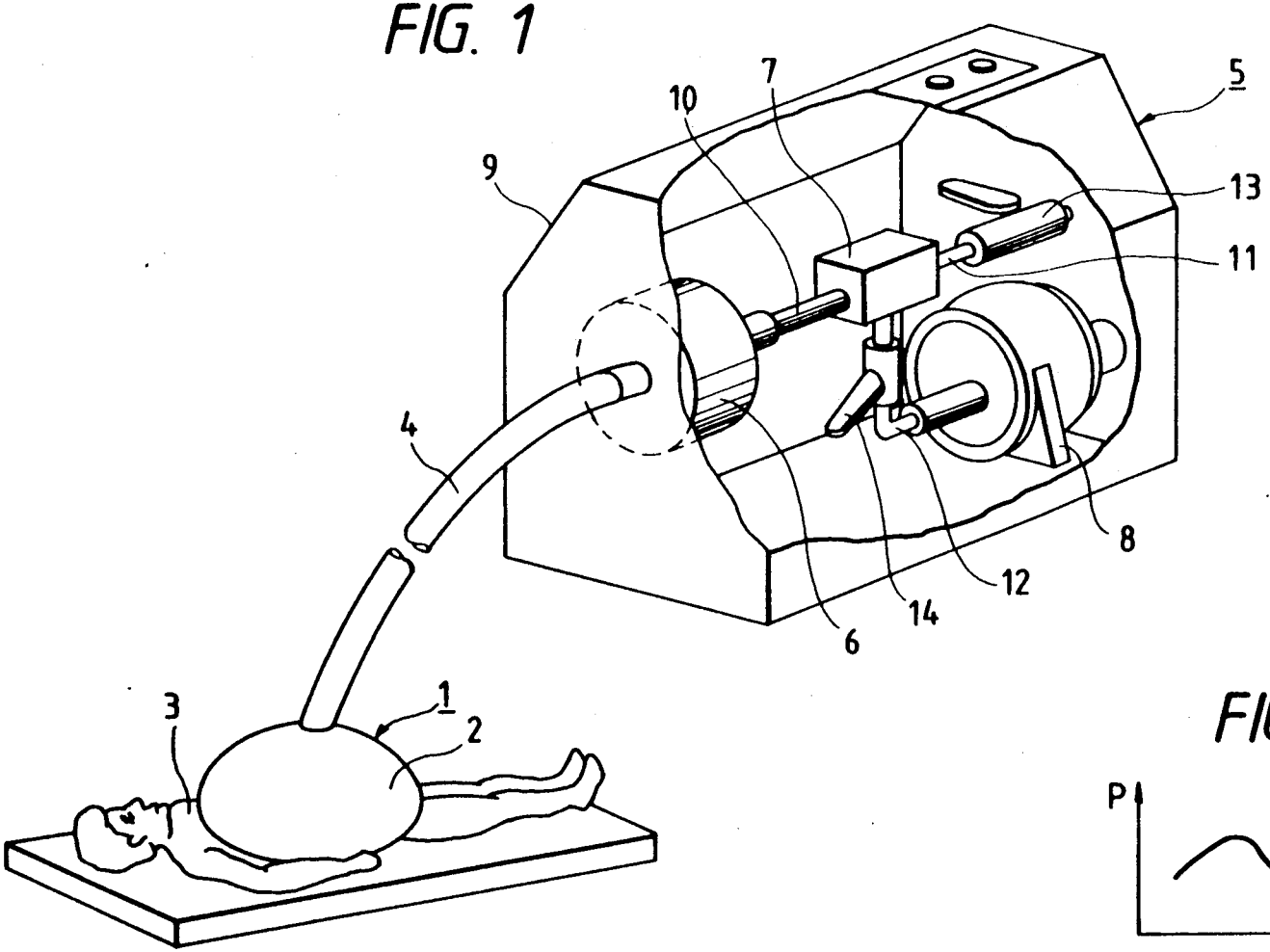
FIG. 1 is a perspective view of a first embodiment of the present invention.

FIG. 1 shows a first embodiment of the present invention. A corset 1 comprises a rigid shell 2 much like a tortoise shell, and a strap member (not shown). The rigid shell 2 has a shape adapted to enclose the thorax of a patient 3, and a packing made of a resilient material is secured to an inner surface of a peripheral edge portion of the rigid shell 2. The rigid shell 2 is adapted to be attached to the thorax of the patient 3 through this packing. The strap member is adapted to extend across the back of the patient 3 in such a manner that the opposite ends of the strap member respectively reach the surfaces of the opposite side portions of the rigid shell 2 attached to the thorax of the patient 3, and the strap member is adapted to be fastened to the rigid shell 2 by flat-type fasteners mounted respectively on the inner surfaces of the opposite side portions of the rigid shell 2. An inspiration tube 4 is connected at one end to a connection port provided in the rigid shell 2, and when the corset 1 is attached to the patient 3, the inspiration tube 4 is in communication with the air-tight chamber formed between the thorax of the patient 3 and the rigid shell 2.

An apparatus body 5 includes an air reservoir (adjustment means) 6 in the form of a sealed box, a three-way directional control valve 7, and a suction pump 8 all of which are received within a casing 9. The air reservoir 6 is in the form of a sealed cylinder. The other end of the inspiration tube 4 is connected to one end of the air reservoir 6 so that the air reservoir 6 is in communication with the interior of the corset 1 via the inspiration tube 4. A first pipe 10 is connected at one end to the other end of the air reservoir 6, and the other end of the first pipe 10 is connected to a first connection port of the three-way directional control valve 7. A second connection port of the three-way directional control valve 7 is open to the atmosphere via a second pipe 11, and a third connection port of control valve 7 is connected to the suction pump 8 via a third pipe 12. First and second throttle valves 13 and 14 are mounted on the second pipe 11 and the third pipe 12, respectively. By a valve actuator means (not shown), the three-way directional control valve 7 performs a switching operation by which the inspiration tube 4 is connected to the suction pump 8 or is communicated with the atmosphere.

The operation of the embodiment shown in FIG. 1 will now be described. First, the operator attaches the corset 1 to the patient 3, and connects the inspiration tube 4 to the connection port provided in the corset 1. At this time, the air-tight sealed chamber is formed between the rigid shell 2 of the corset 1 and the thorax of the patient 3. Also, the three-way directional control valve 7 is held in an atmosphere-opening condition in which the first and second pipes 10 and 11 are communicated with each other. Then, the operator turns on a power source of the apparatus body 5 to operate the suction pump 8, and at the same time the three-way directional control valve 7 is driven by the valve actuator means (not shown) so that the first pipe 10 alternately communicates with the second pipe 11 and the third pipe 12 in a predetermined cycle. By doing so, the air-tight sealed chamber in the corset 1 is brought alternately into a negative pressure and the atmospheric pressure, so that the artificial respiration of the patient 3 is effected in a predetermined cycle.

The time constant $\tau 1$ for the change from the negative pressure to the atmospheric pressure and the time constant $\tau 2$ for the change from the atmospheric pressure to the negative pressure are represented by the following formulas (1) and (2), respectively.

$$\tau 1=(C1+C2)R1 \quad (1)$$

$$\tau 2=(C1+C2)R2 \quad (2)$$

where C1 represents a compliance (volume/pressure) of the air reservoir 6, C2 represents a compliance of the air-tight sealed chamber of the corset 1 and the human body, and R1 and R2 represent fluid flow resistances (pressure/volume × velocity) of the first and second throttle valves 13 and 14, respectively.

Figure 2:
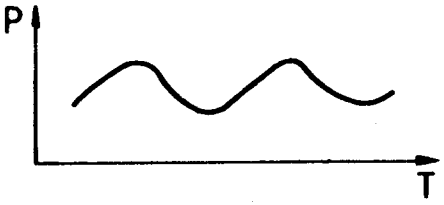
FIG. 2 is a graph showing a pressure waveform according to the invention.
Figure 8:
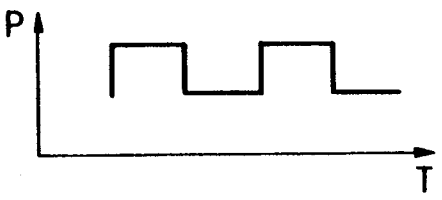
FIG. 8 is a graph showing a pressure waveform according to the conventional respirator of FIG. 7.

Therefore, as compared with the case where there are not provided the air reservoir 6 and the throttle valves 13 and 14 as in the prior art, the time constants are increased because of the addition of a fluid flow capacitance, i.e., air reservoir 6 having compliance C1 and the throttle valves 13 and 14 having flow resistances R1 and R2, respectively. As a result, the variation of the pressure within the corset 1 when switching the fluid flow passage by the three-way directional control valve 7 is as indicated by a waveform in FIG. 2. Further, by suitably selecting the volume of the air reservoir 6 to adjust C1 and by suitably selecting the degree of opening of the throttle valves 13 and 14 to adjust R1 and R2, the time constants $\tau 1$ and $\tau 2$ can be adjusted to their respective optimum values.

In this embodiment, the speed of variation of the pressure within the corset 1 when switching the fluid flow passage by the three-way directional control valve 7 can be rendered gentle, and therefore the patient's pain can be lessened during the artificial respiration.

Figure 3:
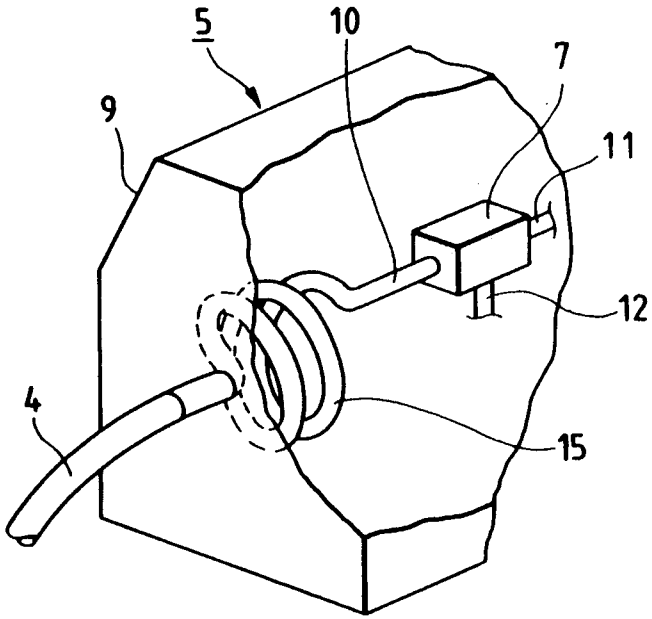
FIG. 3 is a perspective view of a portion of a second embodiment of the invention.

FIG. 3 shows a second embodiment of the present invention. In this embodiment, instead of the air reservoir 6 of the first embodiment, a long spiral pipe 15 is used as the adjustment means and is connected to the inspiration tube 4. The other parts are identical to those of the first embodiment.

In the embodiment shown in FIG. 3, by suitably selecting the length of the spiral pipe 15 and the degree of opening of the throttle valves 13 and 14, effects similar to those of the first embodiment can be achieved.

Figure 4:
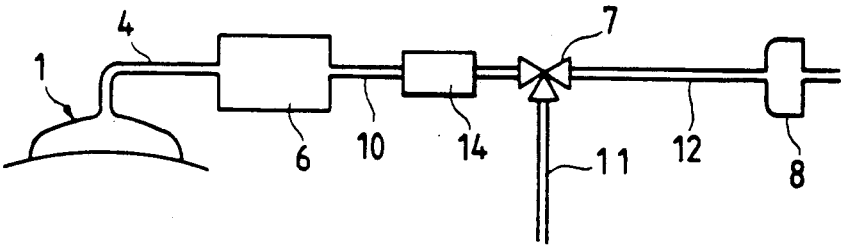
FIGS. 4 to 6 show modified arrangements of the invention, respectively.
Figure 5:
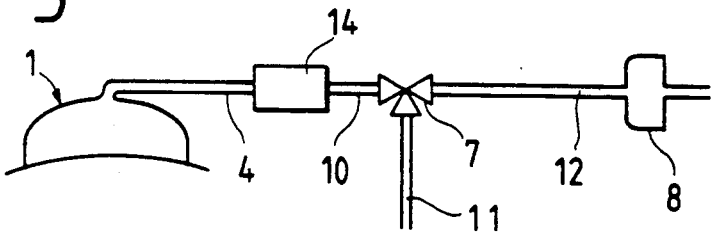
Figure 6:
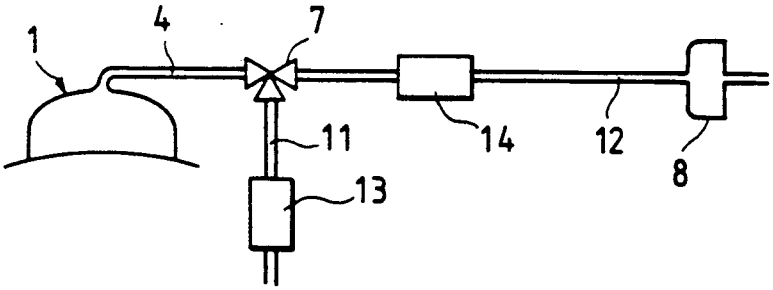
Figure 7:
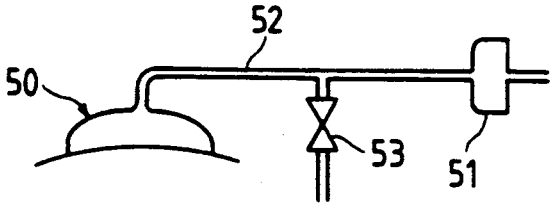
FIG. 7 PRIOR ART
FIG. 7 shows a construction of a conventional artificial respirator.

The arrangement of the air reservoir 6, the three-way directional control valve 7 and the throttle valves 13 and 14 shown in FIG. 1 may be modified as shown in FIGS. 4 to 6.

In FIG. 4, instead of the throttle valves 13 and 14 of FIG. 1, one throttle valve 14 is used and is mounted on a conduit between an air reservoir 6 and a three-way directional control valve 7, and a time constant is defined by the compliance of the air reservoir 6, the compliance of the sealed chamber of the corset 1 and the human body, and the fluid flow resistance of the throttle valve 14.

In FIG. 5, the air reservoir 6 is not included, however, the corset has a volume equal to the volume of the air reservoir 6 of FIG. 4, and a time constant is defined by the compliance of the corset and the fluid flow resistance of the throttle valve 14.

In FIG. 6, the corset has a volume equal to the volume of the air reservoir 6 of FIG. 1, and a time constant is defined by the compliance of the corset and the fluid flow resistances of the throttle valves 13, 14.

Another embodiment of the present invention is provided if, instead of each of the throttle valve 13 and 14, an air filter is used as the means for providing the fluid flow resistance.

Also, the present invention can be achieved if, instead of the air reservoir 6, an air-tight sealed chamber formed by a member in which all or a part thereof is made of a resilient material is used as the means for providing as fluid capacitance. In this case, the volume of the air reservoir 6 required for obtaining the same compliance as that applied by the sealed box made of a rigid member is less.

As described above, in the present invention, the adjustment means for decreasing the speed of variation of the air pressure is provided on the inspiration tube of the outside-of-thorax type negative pressure artificial respirator, and therefore the variation of the pressure within the corset can be made gentle during the artificial respiration, thereby lessening the pain to the patient.

What is claimed is:

1. An artificial respirator having an atmospheric opening, comprising:

a corset for enclosing the thorax of a patient;

an inspiration tube having one end thereof coupled to said corset;

a suction pump;

switching means for selectively connecting one of said suction pump and the atmospheric opening to the other end of said inspiration tube so as to selectively change, according to a time constant, a pressure within said corset between a negative pressure and an atmospheric pressure; and means for increasing the time constant so as to provide a smooth change between the negative and atmospheric pressures within said corset, said increasing means comprising at least one throttle valve coupled to at least one of the atmospheric opening and said suction pump, respectively, and air reservoir means coupled between the other end of said inspiration tube and said switching means.

2. The artificial respirator as defined in claim 1, wherein said corset includes a rigid shell which forms an air-tight sealed chamber between said rigid shell and the patient's thorax.

3. The artificial respirator as defined in claim 1, wherein said switching means is a three-way directional control valve having first, second and third ports, the first port being connected to the other end of said inspiration tube, the second port being connected to said suction pump, and the third port being connected to the atmospheric opening.

4. The artificial respirator as defined in claim 1, wherein said air reservoir means comprises a sealed box.

5. The artificial respirator as defined in claim 1, wherein said air reservoir means comprises a spiral tube, connected to the other end of said inspiration tube.

6. The artificial respirator as defined in claim 1, wherein said increasing means includes a pair of throttle valves, one of said throttle valves being connected to said suction pump, and the other one of said throttle valves being connected to the atmospheric opening.

7. The artificial respirator as defined in claim 1, wherein said increasing means includes a first throttle valve connected between said switching means and said suction pump, and a second throttle valve connected between the atmospheric opening and said switching means.

8. The artificial respirator as defined in claim 1, wherein said increasing means includes an air filter connected between said switching means and said atmospheric opening, and a throttle valve connected between the suction pump and said switching means.

9. The artificial respirator as defined in claim 1, wherein said corset is made from a resilient material.

10. An artificial respirator having an atmospheric opening, comprising:

a corset for enclosing the thorax of a patient;

an inspiration tube having one end thereof coupled to said corset;

a suction pump;

switching means for selectively connecting one of said suction pump and the atmospheric opening to the other end of said inspiration tube as so to selectively change according to a time constant, a pressure within said corset between a negative pressure and an atmospheric pressure; and means for increasing the time constant, said increasing means comprising air reservoir means, and a throttle valve disposed between said air reservoir means and said switching means.

11. The artificial respirator as defined in claim 10, wherein said air reservoir means comprises a sealed box connected to the other end of said inspiration tube.

* * * * *